United States Patent [19]

Tump

[11] Patent Number: 4,915,256

[45] Date of Patent: Apr. 10, 1990

[54] DISPENSER

[75] Inventor: Dereck Tump, Lebanon, N.J.

[73] Assignee: Ortho Pharmaceutical Corporation, Raritan, N.J.

[21] Appl. No.: 749,693

[22] Filed: Jun. 28, 1985

[51] Int. Cl.[4] ..... B65D 83/04

[52] U.S. Cl. ..... 221/5; 221/82; 221/25; 206/534; 206/539; 116/308

[58] Field of Search ..... 221/2, 4–5, 221/25, 76, 86, 89, 69, 64, 82; 206/531–534, 538–539; 116/308

[56] References Cited

U.S. PATENT DOCUMENTS

| | | | |
|---|---|---|---|
| 579,474 | 3/1897 | De Barry | 116/308 |
| 3,143,207 | 8/1964 | Wagner | 221/89 |
| 3,276,573 | 10/1966 | Kaufman et al. | 116/308 |
| 3,437,236 | 4/1969 | Huck | 221/86 X |
| 3,557,747 | 1/1971 | Rigney et al. | 221/86 X |
| 4,165,709 | 8/1979 | Studer | 221/5 X |

*Primary Examiner*—Joseph J. Rolla
*Attorney, Agent, or Firm*—Benjamin F. Lambert

[57] ABSTRACT

A dispenser for dispensing a series of different pills over a prescribed period. The dispenser is provided with an indicator that is adjustable to preset the start of the pill regimen on whatever day desired. The pill package and dispenser are constructed and arranged so that after the indicator has been preset the pill package can be fixedly positioned in the dispenser with the first pill of the regimen in position to be taken by the user on the first preselected day.

1 Claim, 4 Drawing Sheets

FIG. 1
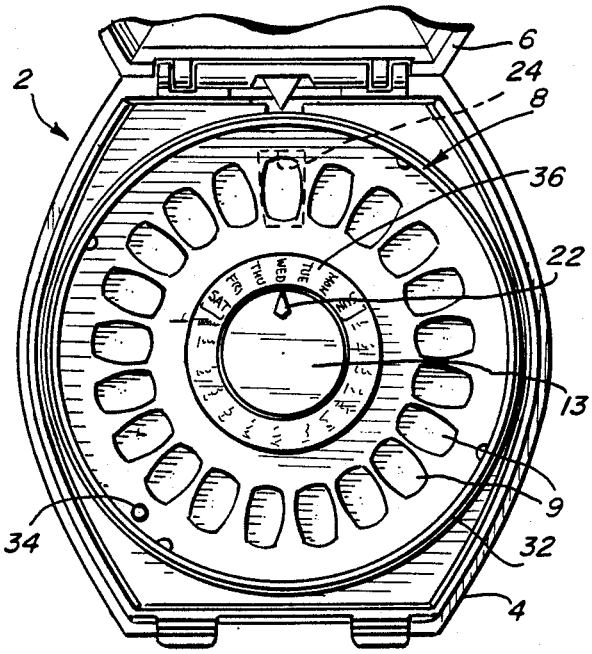
FIG. 2
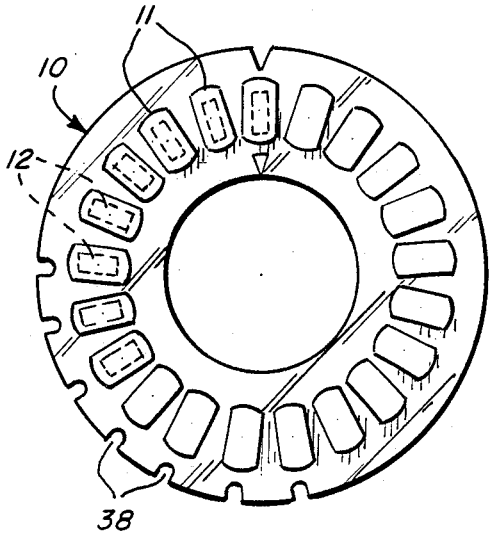
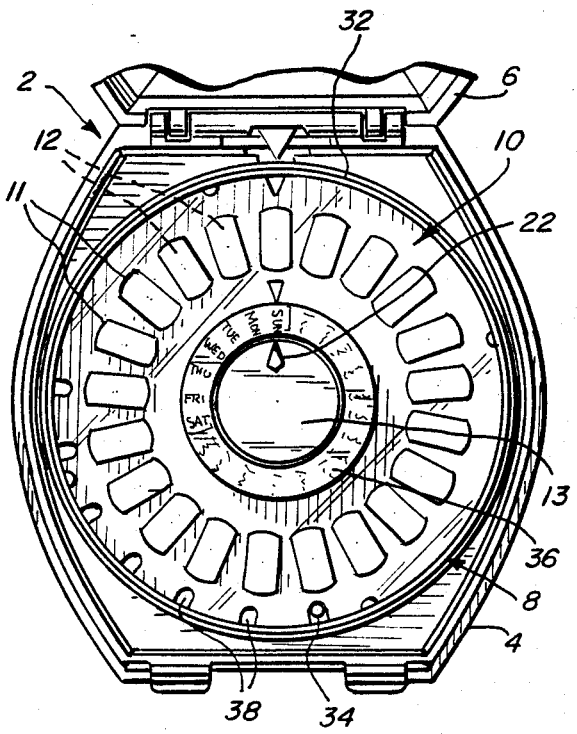
FIG. 3
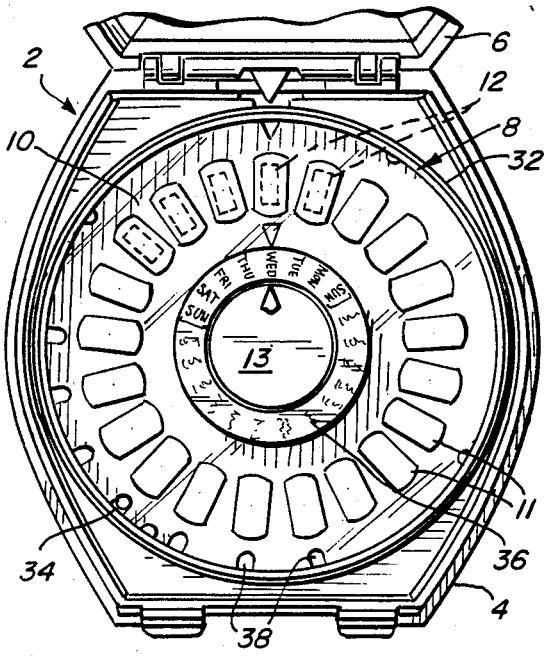
FIG. 4

FIG. 6
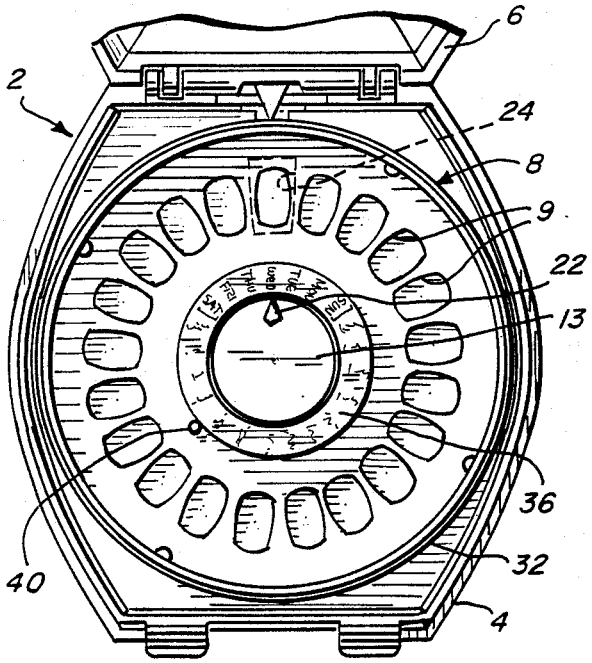
FIG. 7
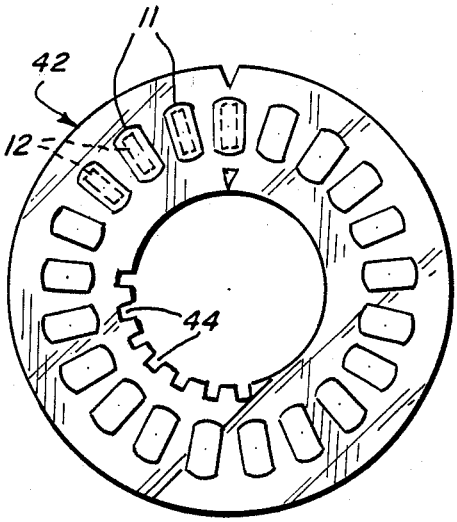
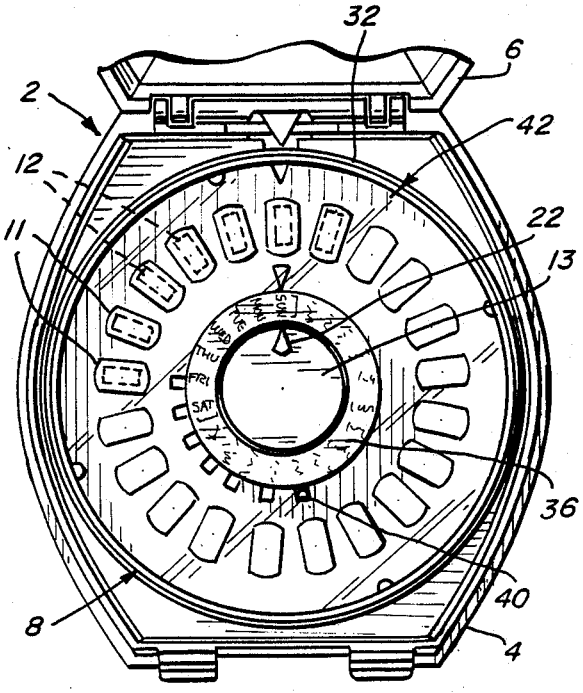
FIG. 8
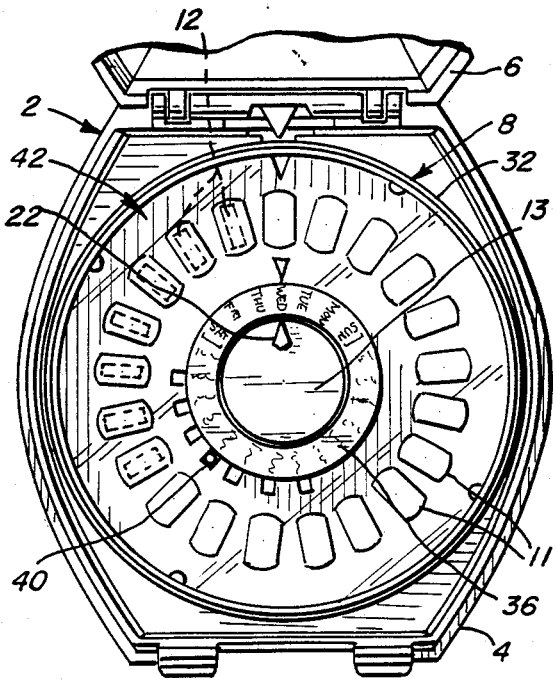
FIG. 9

FIG. 10
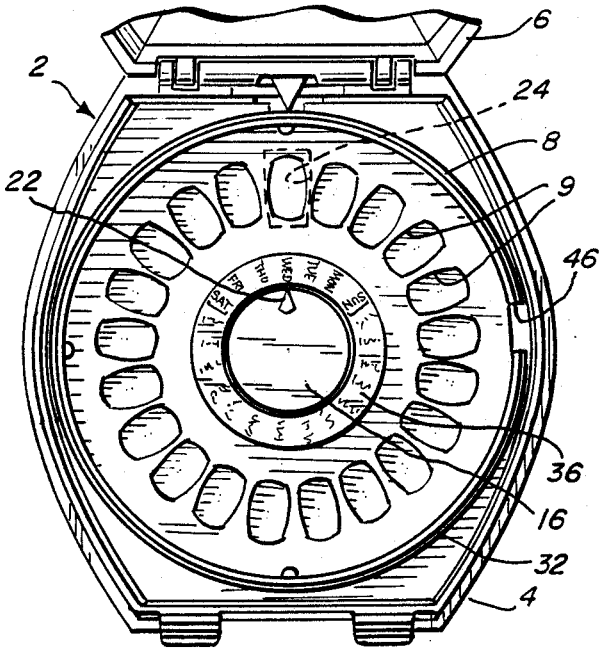
FIG. 11
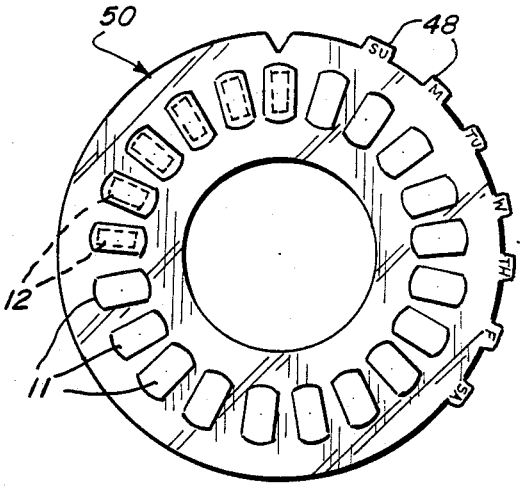
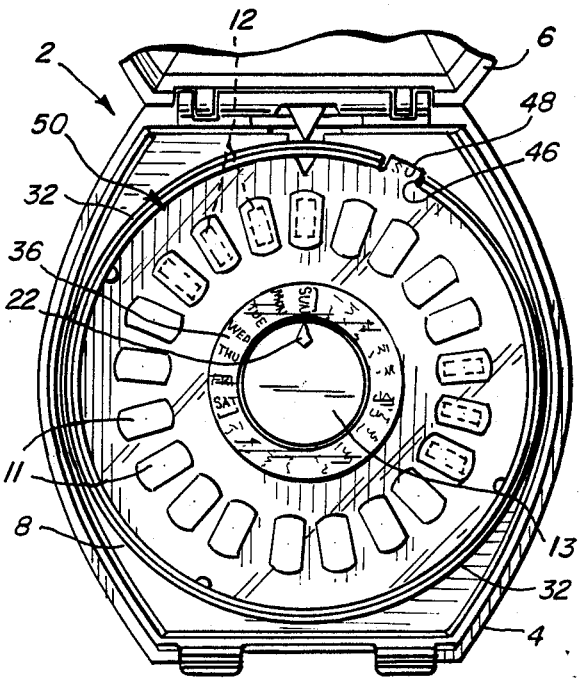
FIG. 12
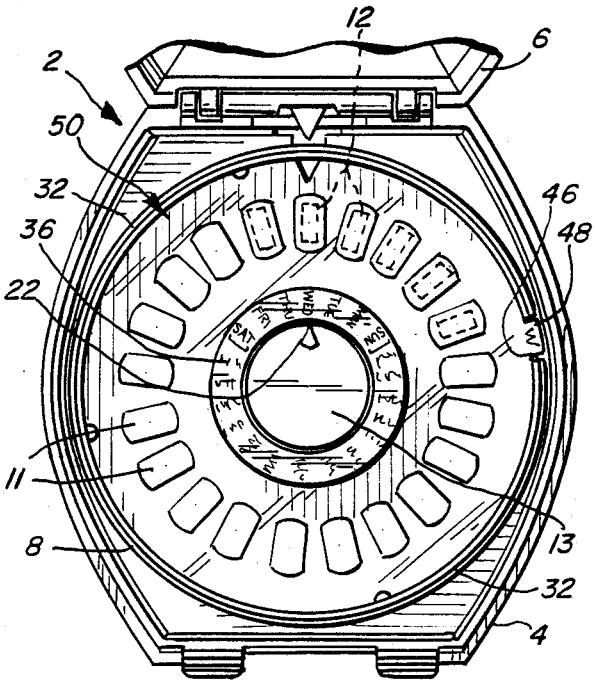
FIG. 13

DISPENSER

BACKGROUND OF THE INVENTION

The present invention relates to a device for dispensing solid medicine in the form of pills or tablets which are to be taken in some sort of periodic regimen.

There are various types of dispensers on the market for dispensing pills or tablets on a periodic basis. Dispensers of the type in question are marked with some sort of an indicator, and they indicate to the user the particular time periods they are to be taken. A typical dispenser is one for dispensing tablets to be taken on a daily basis, such as, birth control pills. However, it can be appreciated that this is but one form of medicine that could be dispensed by the dispenser, and it is intended to cover dispensers to be used with any medicine taken in a solid pill form on a periodic basis.

The present invention relates to an improvement in a dispenser of the type described in assignee's U.S. Pat. No. 4,165,709. This patent discloses a novel dispenser, but is deficient in that it is designed for the user to start taking the first tablet of the regimen consisting of different tablets on a preset day, such as, a Sunday. Thus, if the user is to begin taking the first tablet of the regimen on some day other than a Sunday, he either has to ignore the indicator, or wait until Sunday before he begins taking the pills from the dispenser. It can be appreciated that in the case of birth control pills, the user would be at risk if she does not start at the time she should be starting, which would be at a prescribed time relating to the user's menstrual cycle.

SUMMARY OF THE INVENTION

The present invention relates to a novel dispensing device which, while similar in many respects to that disclosed in assignee's U.S. Pat. No. 4,165,709, is an improvement thereover by enabling the user to start taking the tablets of the prescribed regimen on a day to be selected by the user. This is brought about by a modification of the dispenser illustrated in said '709 patent in conjunction with a modification of the blister package containing the pills to be dispensed by the dispenser.

In the present invention, the tablet dispensing device includes a flat support having a single tablet-dispensing aperture. Mounted with respect to the support is a tray having a plurality of openings which are arranged to individually align in registration with the aperture in the support upon rotation of the tray. Disposed in the tray is a tablet-dispensing package containing a plurality of tablets that are individually dispensible through individual openings in the tray when they are aligned with the tablet dispensing aperture in the support. Subsequent tablets are individually dispensed by rotating the tray to align sequential tray openings with the aperture.

In a preferred embodiment of the invention, the tray, which can be moved relative to the support, includes thereon an indicator of periodicity. In the instant application, there is shown a daily indicator which in the illustrated embodiment covers a period of three weeks. The tray contains an indicia indicator which aligns with an arrow affixed on an upper surface of a hub formed integral with the support. Located in alignment with the indicator and arrow is a tray opening which is disposed above the aperture opening in the support. Since movement of the tray carries with it the periodicity indicator, and since the user wants to set the day that she is to take the first pill in a regimen of different pills, the user will rotate the tray so that the day the first pill is to be taken is in alignment with the first pill in the regimen. It can be appreciated that in order for this to be effective, the tablet dispensing package made up of more than one kind of tablet must be so positioned that the first pill of the regimen is located in alignment with the dispensing opening. In addition, however, it is essential that the blister pack be fixed with respect to the tray so that once the blister package is positioned within the tray, it will not move relative thereto. Obviously, if any relative movement were permitted to occur then, of course, there stands the possibility that the package will be moved out of position and the user will not know whether or not she has taken the requisite pill on the prescribed day.

In order to accomplish the above, in a preferred embodiment, the dispenser is provided with an aligning pin which in conjunction with the blister pack will positively locate the blister pack relative to the tray, so it moves with the tray when the tray is rotated. In order to permit the blister pack to be positioned at various locations within the tray to align the first tablet of the regimen with the arrow indicating when the first tablet is to be taken it is provided with a series of peripherally spaced notches in the outer circumferential portion of the tray that are designed to receive the pin. Thus, it can be appreciated that when the tray is located to align the proper day the first pill of the regimen is to be taken, the blister package must be capable of being disposed in the tray with the proper day aligned with the first pill to be taken and thereafter be maintained in position relative to the tray by the interfit between the appropriate notch and the pin extending upwardly from the tray. There are seven notches provided corresponding to the days of a week. Thus, whatever day is selected to be the first day a pill is to be taken there will be a corresponding notch into which the locating pin will fit.

In another embodiment of the invention, the adjustable setting of the tray to permit starting of the regimen at whatever day desired is accomplished by providing a pin located in the inner circumferential area of the tray adjacent the indicator portion of the tray and providing the blister pack with seven of notches disposed about an inner circumferential portion of the generally annular blister package.

A third embodiment of the invention provides for the utilization of the same tray mechanism found in assignee's '709 patent, but provides for a blister package having each of the days of the week indicated in tabs extending outwardly from the blister package. The tray in this instance is provided with a notch into which a tab indicating the day of the week selected for the first tablet of the regimen is placed, and the other tabs are bent downwardly to be out of engagement with the tray. Thus, after the tray has been set to the desired day, i.e., a Wednesday, all of the tabs except the one marked with a "W" are bent down, and the "Wednesday" tab is placed in the notch in the tray, and thus the tablet package is positively located with respect to the tray, and the tray is preset to start on the day desired by the user.

In accordance with the principles of this invention, the dispenser hereof provides a way for conveniently dispensing a tablet on a time related regimen starting with whatever day of the week the user desires. The various embodiments illustrated incorporate a replaceable tablet package so that if desired the dispenser can be reused many times by merely removing the exhausted tablet package and inserting a new full tablet package. It is seen that the dispenser can be easily handled and its compact configuration allows it to be used simply and efficiently.

BRIEF DESCRIPTION OF THE DRAWINGS

Numerous other advantages and features of the present invention will become readily apparent from the following detailed description of the invention, from the claims, and from the accompanying drawings in which like numerals are employed to designate like parts thoughout the same.

FIG. 1 is a partial plan view of an open dispenser showing the tray in position to receive a tablet package;

FIG. 2 is a tablet package to be used in the embodiment shown in FIG. 1;

FIG. 3 shows a tablet package inserted in the tray, with the tray positioned so that the first tablet is to be taken on a Sunday;

FIG. 4 shows the position of the tablet package when the tray has been set for the first tablet to be taken on a Wednesday.

FIG. 6 is a view similar to FIG. 1 showing a second embodiment wherein the tablet package locating means is disposed adjacent the indicator mechanism;

FIG. 7 is a view showing the tablet dispenser to be used in conjunction with the embodiment shown in FIG. 6;

FIG. 8 shows the second embodiment of the tablet dispenser assembled with the package in position and tray set for the first tablet to be taken on a Sunday;

FIG. 9 is a view similar to FIG. 8 showing the position of the various components when the first tablet is to be taken on a Wednesday;

FIG. 10 is a view similar to FIG. 1 showing a third embodiment of the invention;

FIG. 11 is a view showing the tablet package to be used with the embodiment shown in FIG. 10;

FIG. 12 is a view of the third embodiment showing the package inserted in the tray, with the first tablet to be taken on a Sunday; and FIG. 13 is similar to FIG. 12, but showing an assemblage in which the first tablet is to be taken on a Wednesday.

Figure 5:
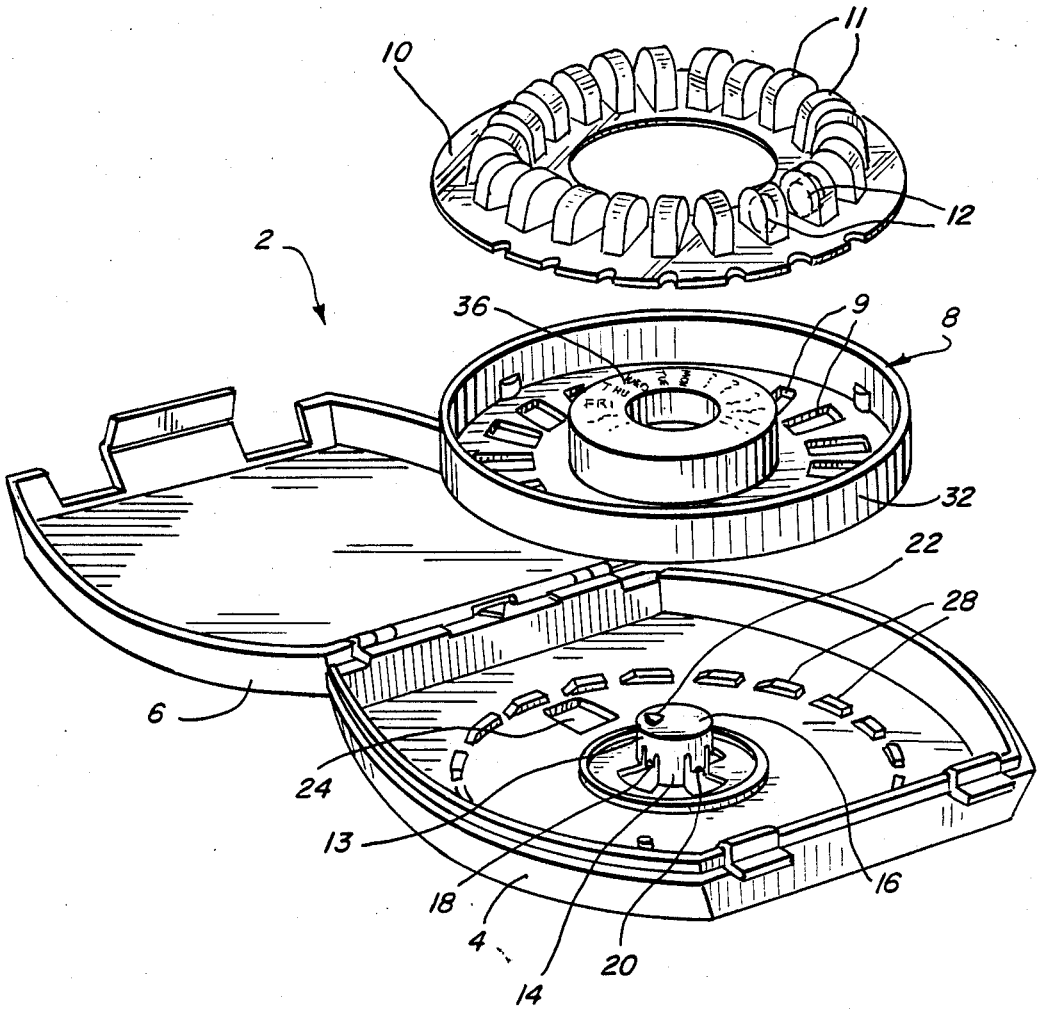
FIG. 5 is an exploded perspective view of the components of the dispenser shown in FIGS. 1–4.

It is again to be noted that a number of the major components of the dispenser are illustrated in this application and described in detail in assignee's U.S. Pat. No. 4,165,709. While a number of the features will be described in this application in order to provide a general overall understanding, the aforementioned '709 patent is incorporated here by reference where details of common parts are desired.

Referring first to FIG. 5, there is illustrated in an exploded perspective form the embodiment of the tablet dispenser 2 shown in FIGS. 1–4. The dispenser 2 consists of four major components, including a support 4, a cover 6, a tray 8, and a tablet package 10. It is to be noted that where the various components, such as, the support, hub, periodicity indicator, tablets, pointer, etc., are identical in a of the embodiments, the same numbers will be used throughout.

The support 4 is a substantially flat member which serves to carry and support the tray 8 defining a plurality of openings 9 and tablet package 10. The tablet package 10 is annular is shape and defines a V notch indicating the first tablet of the regimen made up of more than one kind of tablet. The package contains a plurality of collapsible pockets 11, each of which contains a tablet 12. The pockets 11 are arranged in a circular orientation and are equally spaced apart to correspond to the tray openings 9. The pockets 11 are covered with a frangible membrane (not shown) interposed between the pockets 11 and the tray openings 9.

Located in the center of the support 4 is a raised hub 13 which has a generally cylindrical configuration having eight spoke-like elements forming a ring about its circumference. Four of the spokes are support spokes 14 which extend generally vertically from the support 4 to the raised upper portion 16 of the hub 13. Disposed between the aforementioned support spokes are four resilient spokes 18 which extend downwardly from the upper portion 16 of the hub 13 to an area above the base of the flat support 4. Located on the resilient spokes 18 are protuberances 20 which cooperate with the tray 8 when the tray is positioned in the support to retain the tray in its proper position relative to the support. That is to say, the tray 8 is vertically restrained, but is free to rotate relative to the support 4.

Located on the flat upper portion of the hub is a pointer 22 which fixedly points to the single dispensing aperture 24 in the support 4 through which tablets 12 are to be dispensed. To complete the basic components of the dispenser, there is provided a hinged cover 6 which is sized and shaped to serve as a protective member.

Movement of the tray in one direction relative to the support is accommodated by ratchet teeth 28 on the support which cooperate with teeth on the underside of the tray (not shown). The teeth 28 on the support correspond to the number of tablets 12 included in the tablet package which in turn is equal in number to the tray openings 9. Thus, for each incremental movement of the tray past the tooth, the tray moves a subsequent opening 9 in position to dispense another tablet 12. In the case of a dispenser to be primarily utilized to dispense birth control pills to be taken on a daily regimen, it is suitable to design the dispenser to accommodate twenty-one tablets, or twenty-eight, but in the embodiment shown there are twenty-one tablets provided for.

In the various embodiments of the invention, the tray is designed to accommodate various designs of blister packages. Referring to FIGS. 1–5, it is to be noted that the tray 8 in this instance is a tray having a generally complete cylindrical wall 32 adjacent to which are provided the plurality of circumferentially spaced tray openings 9. Located adjacent the tray wall 32 and extending upwardly from the tray's bottom wall is a pin 34, the function of which will be described hereinafter. In this embodiment, as in all the other embodiments, the tray includes an integral annular periodicity indicator 36 which has marked thereon the days of the week over a several-week period. As previously mentioned, when the tray 8 moves relative to the support 4, the indicator 36 is rotated to indicate succeeding days with respect to the fixed pointer 22 that is in alignment with the dispensing aperture 24 in the support 4.

As previous mentioned, it is essential that the user be able to preset the day the first tablet of the regimen is to be taken. The tablet package 10 is produced to be used to dispense a sequence of different tablets starting with the day the first tablet is to be taken. Thus, if the first tablet is to be taken on a day such as a Wednesday, it is necessary that the first tablet in the regimen be in alignment with the pointer 22 on the hub portion 16 and the Wednesday marking on the indicator. With such alignment, the first tablet is disposed over the dispensing aperture 24 located in the support. It can be appreciated that depending on the day that the first tablet is to be taken, the tablet package in conjunction with the tray would have to be designed so that when the first tablet is in alignment with the day preselected the package will not move relative to the tray once it is located in position. To this end, the tablet package 10 is provided with a seven notches 38, each of which can receive the pin 34 formed integral with the bottom of the tray 8. Thus, the tablet package 10 would be placed in a position in a tray where the first tablet lines up with the pointer 22 and dispensing aperture 24 and in this position the pin 34 will fall into one of the notches 38 since there is one notch provided for every day of the week. When the table package is so located, the position of the package is fixed relative to the tray and will move therewith.

For example, when referring to FIGS. 3 and 4, it will be seen that the pin 34 is moved clockwise approximately forty-five degrees when the tray has been moved so that the first tablet to be taken has been changed from Sunday to Wednesday. However, since the tablet package contains notches that are capable of receiving the pin to accommodate whichever of the seven days has been selected for the first tablet to be taken, the tablet package 10 will always be located in a fixed position relative to the tray when it is placed in the tray.

Referring now to FIGS. 6 through 9, the embodiment illustrated therein is identical with the embodiment of FIGS. 1–4, except that the tray is provided with a pin 40 that is disposed immediately adjacent the periodicity indicator. Also, in order for the tablet package 42 of this embodiment to be positively located in position relative to the tray 8, it is provided with seven circumferentially spaced notches 44 that are circumferentially located in the inner annular portion of the tablet package 42. As shown in FIGS. 8 and 9, the tray 8 is shown as being rotated to align two different starting days the first tablet is to be taken with the pointer 22 on the upper hub portion 16. After this has been done, the package 42 is located in position with the first tablet as indicated by the V-groove in place with the dispensing aperture 24. For example, in FIG. 8 the first day the tablet is to be taken is set for Sunday, and thus the pin is in the notch located in approximately the 6 o'clock position. However, as shown in FIG. 9, the first tablet is to be taken on Wednesday, and the tray has been moved to align Wednesday with the pointer 22, and the pin 40 will have been moved approximately forty-five degrees in a clockwise direction. However, since the tablet package is provided with sufficient notches 44 to receive the pin for whichever of the seven week days is preselected, the package can be positioned in the tray and will be fixed relative thereto.

Referring now to the embodiment shown in FIGS. 10–13, it is seen that this embodiment looks very similar to that shown in assignee's U.S. Pat. No. 4,106,709. However, as distinct from the embodiment shown in the '709 patent, the tablet package is designed to be placed in the tray to receive the tablet package in any one of seven positions, so that the user can set the tray to take the first tablet on any day selected. In this situation, the tray 8 is provided with a notch 46 to which a tab 48 on the tablet package 50 fits and when the tray is preset to a given day of the week, the corresponding tab day on the tablet package 50 is retained and the other tabs are turned downwardly so that the package can be placed in position with the respective tab in place in the notch 46. The tablet package is thus positively positioned with respect to the tray.

Two examples of this are illustrated in FIGS. 12 and 13. As shown in FIG. 12, when the starting day is Sunday, the Sunday tab is left up and disposed in the tray notch 46. When the starting day is Wednesday, the Wednesday tab is the only one left up, as shown in FIG. 13.

It can be seen that the various embodiments illustrated enable the user to set the dispenser and/or package to take the first tablet of a series of tablets not all of which are the same to whatever day of the week is required. It is this improvement which is not present in assignee's '709 patent.

It is intended to cover by the following claims all such modifications as fall within the true spirit and scope of the invention.

What is claimed is:

1. A tablet dispenser comprising:

a substantially flat support having a single tablet dispensing aperture therein;

a tray rotatably disposed relative to said support and having an upstanding wall defining a notch, said tray having a plurality of openings disposed in a circular orientation and spaced substantially equally apart and arranged to individually align in registration with said aperture in said support upon rotation of said tray relative to said support, a periodicity indicator mounted on said tray and associated with each of said openings, interengaging means defined by said support and tray whereby said tray is rotatably positioned relative to said support; and a removable annular tablet package disposed on said tray comprising a plurality of collapsible pockets each containing a tablet therein, said pockets arranged in a circular orientation and substantially equally spaced apart to thereby correspond with the orientation of said openings in said tray so that a tablet is disposed in alignment with each of said openings, said pockets being covered with a frangible membrane interposed between said pockets and said openings, said package defining a plurality of tabs wherein one of them will fit in said notch to positively locate said package with respect to said tray and rotatable therewith, whereby the starting period for the first tablet of a regimen can be preset to any starting day desired by moving the tray and associated periodicity indicator to the desired day, locating the tablet package in position by bending down all the tabs but the preselected first day and dispensing the tablets in the desired sequence by collapsing the pocket which is in registry with said aperture, thereby urging said tablet to fracture said membrane and pass through its corresponding opening and then through said aperture in said support for collection by the user thereof.

* * * * *